United States Patent [19]

Bangert et al.

[11] 4,203,238

[45] May 20, 1980

[54] RAPID-CHANGE DEVICE FOR ATTACHMENTS ON EARTH MOVING MACHINES

[75] Inventors: Hans Bangert, Sprockhövel; Georg Fengler, Bergkamen-Oberaden, both of Fed. Rep. of Germany

[73] Assignee: O & K Orenstein & Koppel Aktiengesellschaft, Berlin, Fed. Rep. of Germany

[21] Appl. No.: 929,693

[22] Filed: Jul. 31, 1978

[30] Foreign Application Priority Data

Aug. 3, 1977 [DE] Fed. Rep. of Germany ..... 2734972

[51] Int. Cl.[2] ..... E02F 3/00

[52] U.S. Cl. ..... 37/118 R; 414/723; 172/272

[58] Field of Search ..... 37/117.5, 118; 172/272–276, 801; 414/722, 723

[56] References Cited

U.S. PATENT DOCUMENTS

| | | | |
|---|---|---|---|
| 3,876,091 | 4/1975 | MacDonald | 414/723 |
| 3,883,015 | 5/1975 | Gorby | 414/723 |
| 4,085,856 | 4/1978 | Westendorf | 414/723 |
| 4,106,645 | 8/1978 | Janish | 414/723 |
| 4,116,346 | 9/1978 | Uchida | 172/273 X |
| 4,119,225 | 10/1978 | Macht et al. | 414/723 |
| 4,136,792 | 1/1979 | Wilson | 414/723 |

FOREIGN PATENT DOCUMENTS

| | | | |
|---|---|---|---|
| 852583 | 9/1970 | Canada | 414/723 |
| 7405218 | 4/1974 | Netherlands | 172/272 |

*Primary Examiner*—E. H. Eickholt
*Attorney, Agent, or Firm*—Martin A. Farber

[57] ABSTRACT

A rapid-change device for attachments on earth moving machines for connection between a lift chassis, which is hydraulically actuated from the carrier vehicle, and an attachment implement, for instance a loading shovel, by means of holding claws and locking latches. The locking latches are pivotally mounted on the outer periphery of hubs which are fixed on stay arms. The lift arms of the lift chassis are coaxially pivotally mounted in bores of the hubs. The stay arms are provided with holding claws having semicircular recesses which are adapted to receive holding bolts of the loading shovel. The center points of the semicircular recesses of the holding claws and the pivot points of the locking latches are coordinated with respect to each other such that the line of action of the reaction forces which are introduced by the loading shovel extends through the pivot points for the locking latches and through the center points of the recesses or above the center points of the recesses.

7 Claims, 2 Drawing Figures

RAPID-CHANGE DEVICE FOR ATTACHMENTS ON EARTH MOVING MACHINES

Figure 1:
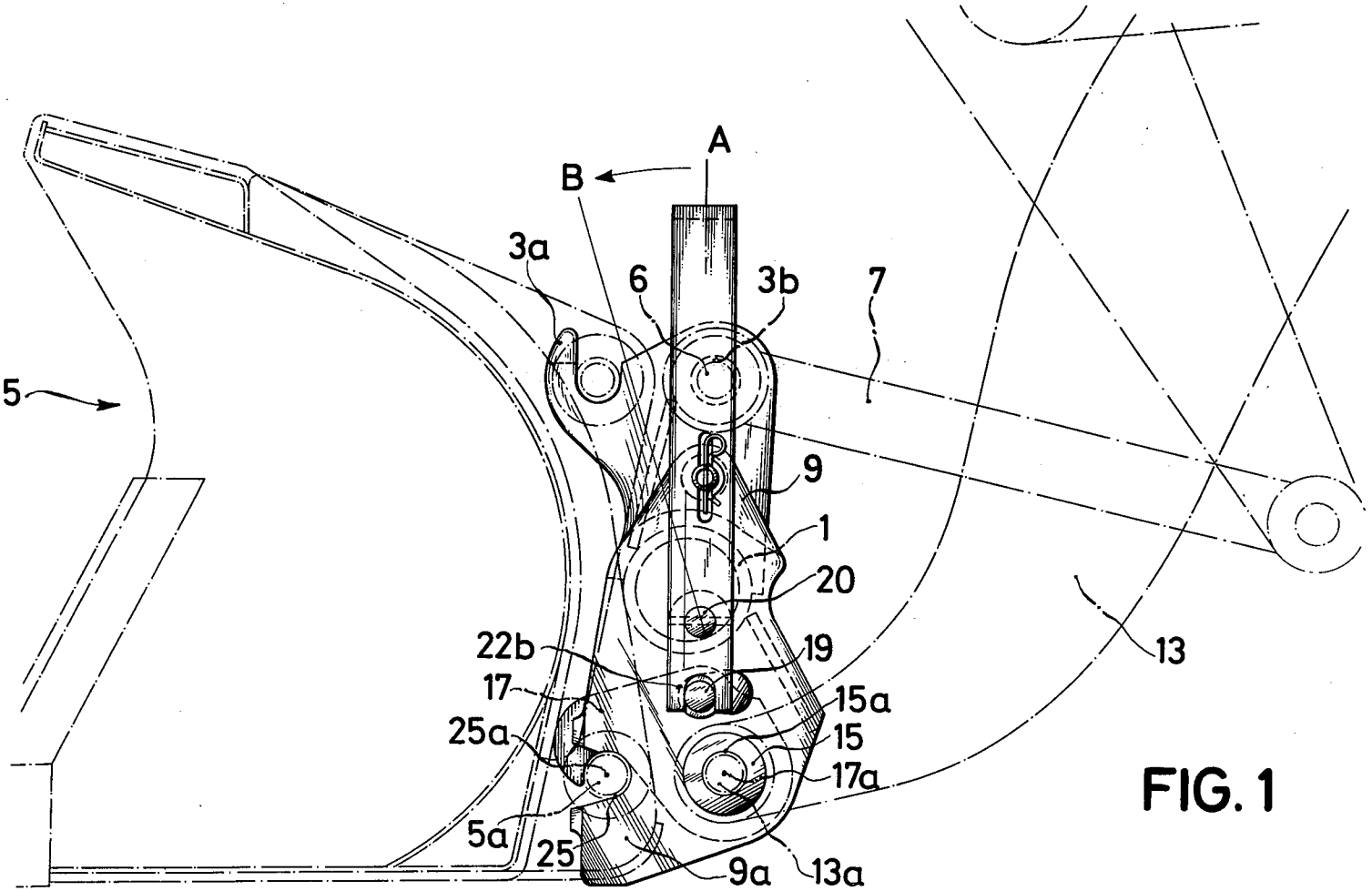

The invention relates to a rapid-change device for attachments on earth moving machines for connection between a lift chassis, which is hydraulically actuated from the carrier vehicle, and an attachment implement, for instance a loading shovel, by means of holding claws and locking catches or latches.

In one known fastening device for tools or attachments the interlock between the attachment-holder and the loading or work attachment is effected by claws and catches which serve to secure the work attachment to the fork carriage. The catches are mounted on a shaft which serves for the interlocking. The points of mounting of the catches lie between the points of support of the fastening device and attachment holder, on the one hand, and the fastening device and the loading or working implement on the other hand. This results in a relatively large distance between the loading shovel and the attachment holder, in a reduction in the depth of digging of the loading device, and in an undesired transmission of the forces which are introduced by the loading device via the locking catches to the interlocking device.

It is an object of this invention to provide a rapid-change device for the fastening of attachments, by which the forces introduced by an attachment, for instance a loading shovel, do not exert an opening moment on the locking catches which serve for the locking of the attachment to the lift chassis and no externally acting forces are exerted on the shift shaft which serves for actuation of the locking catches. Furthermore, the distance between the attachment and the lift chassis of the carrier vehicle is to be changed as little as possible by the addition of the rapid-change device and the lowest position of the loading shovel is to remain the same, whereby the bearing points between the rapid-change device and the lift chassis, on the one hand, and between the rapid-change device and the attachment, on the other hand, are to be the same, even when using a rapid-change device.

It is another object of the invention to aid the solution of the above-mentioned object in the manner that the locking catches or latches (16 and 17) are swingably mounted on the outer periphery of hubs (14 and 15) which are arranged fixed on arms (8 and 9), lift arms (12 and 13) of the lift chassis being coaxially pivotally mounted in bores (14*a* and 15*a*) of the hubs, and that the center points (25*a*) of the semicircular recesses (25) of the holding claws (8*a* and 9*a*) (which recesses are arranged in the stay arms (8 and 9) and serve to receive holding bolts (5*a*) of the loading shovel (5) and the pivot points (16*a* and 17*a*) of the locking latches (16 and 17) are coordinated with respect to each other such that the line of action of the reaction forces which are introduced by the loading shovel (5) extends through the pivot points (16*a* and 17*a*) for the locking latches (16 and 17) and through the center points (25*a*) of the recesses (25) or above the center points (25*a*) of the recesses (25).

It is another object of the invention further to mount the locking latches (16 and 17) independently of each other on hubs (14 and 15), the latter being arranged fixed on the stay arms (8 and 9), and to mount a shift shaft (20) (which shift shaft serves to actuate the locking latches (16 and 17) in bores (8*c* and 9*c*) of the stay arms (8 and 9).

It is still another object of the invention to pivotally mount the shift shaft (20) which serves for the actuation of the locking latches (16 and 17) within a tubular cross member (1), the latter carrying the locking latches (16 and 17) and holding claws (8*a* and 9*a*), which latches and holding claws are arranged on both sides.

Figure 2:
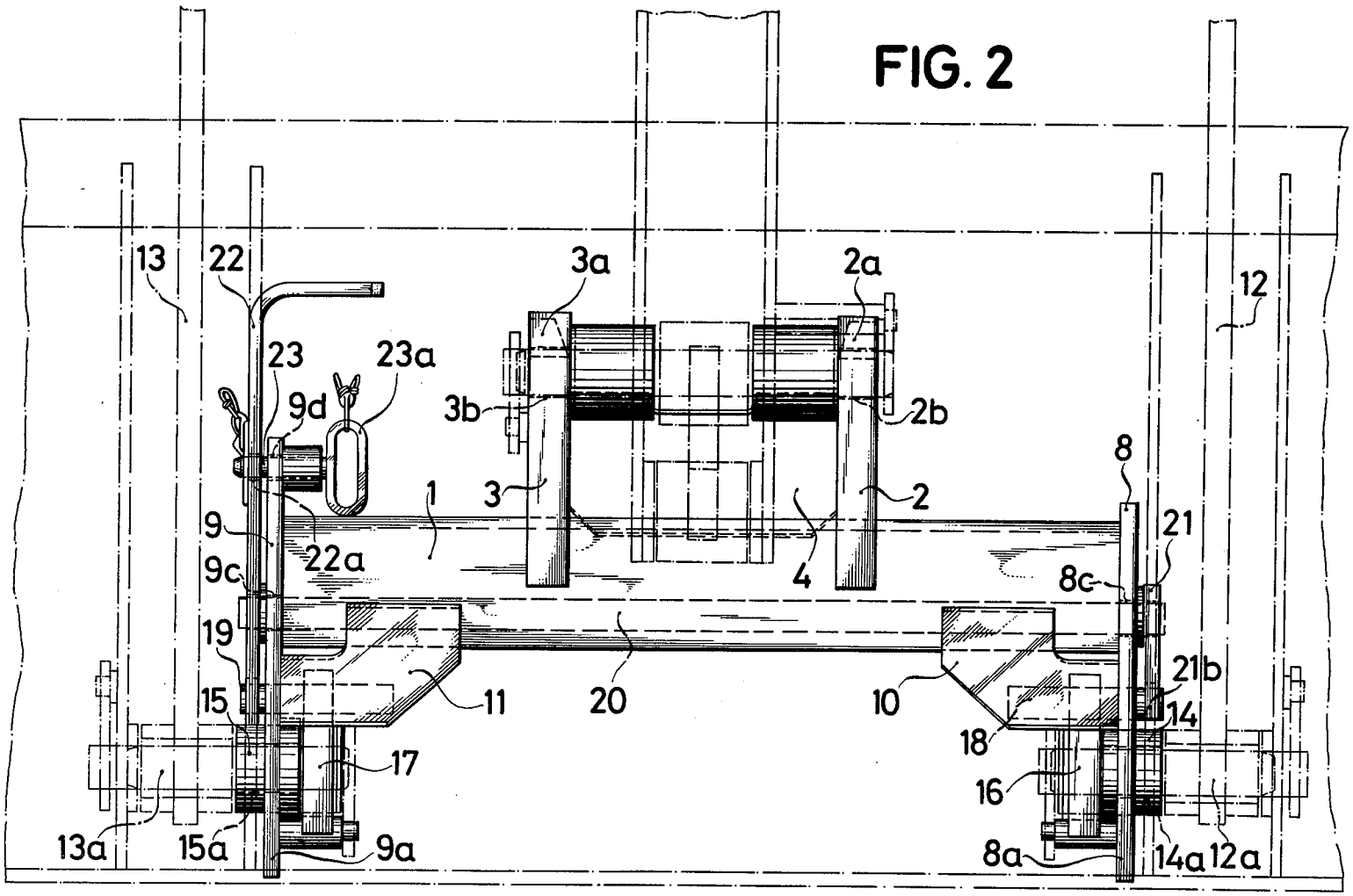

With the above and other objects and advantages in view, the present invention will become more clearly understood in connection with the following detailed description of a preferred embodiment, when considered with the accompanying drawings, of which:

FIG. 1 is a front view of the fastening device in accordance with the present invention; and FIG. 2 is a side view of the fastening device.

Referring now to the drawings, two stay arms 2 and 3 are welded to the middle one-third portion of a tubular cross member 1. The arms 2 and 3 are supported with respect to the tubular cross member 1 by means of the support plate 4. The arms 2 and 3 are each provided with a claw 2*a* and 3*a*, respectively, such claws being open at the top in order to receive a loading shovel 5 which is supported in the claws 2*a* and 3*a* by means of bolts which are welded onto the shovel 5. Bores 2*b* and 3*b* are formed in the arms 2 and 3, in which bores a traction rod 7 which serves to actuate the loading shovel 5 engages by means of a bolt 6. Stay arms 8 and 9 are welded to the two free ends of the tubular cross member 1, which stay arms 8 and 9 are supported with respect to the tubular cross member 1 by means of support plates 10 and 11, respectively.

The stay arms 8 and 9 are each provided with a holding claw 8*a* and 9*a*, respectively, which claws are open towards the front and towards the side and are adapted to receive the loading shovel 5, each claw being formed with a bore 8*b* and 9*b*, respectively, in which the lift arms 12 and 13 of the lift chassis (not otherwise shown) are mounted by means of bolts 12*a* and 13*a*. Hubs 14 and 15 are furthermore welded in the arms 8 and 9, the locking catches or latches 16 and 17 being mounted in the hubs. Pins or cogs 18 and 19 are fastened to the locking latches 16 and 17. A shift shaft 20 is mounted in the bores 8*c* and 9*c*, and the levers 21 and 22 are fastened to the free ends of the shaft. The lever 22 can be fastened by means of the bolt 23 which is inserted through the hole 22*a* in the lever 22 and through the bore 9*d* in the arm 9. The bolt 23 is actuated by means of the handle 23*a*.

In use the manner of operation of the device in accordance with the invention is as follows:

When the loading shovel 5 is to be attached or assembled onto the carrier device, the lever 22 is moved from position A into position B. For this it is necessary to remove the bolt 23 from the hole 22*a* of the lever 22. The force which is then introduced on the lever 22 at its bent end is transferred on the one side via the fork-shaped end 22*b* of the lever 22, and on the other side, by means of the shift shaft 20 and via the fork-shaped end 21*b* of the lever 21, to the pins 19 and 18 of the locking catches 17 and 16 with their pivot points 17*a* and 16*a*, respectively. These forces which are exerted on the locking latches 16 and 17 cause the latches to release the holding claws 8*a* and 9*a*.

The bolt 23 is now inserted through the hole 9*d* in the arm 9 up to the handle 23*a*, so that the free end of the bolt 23 fixes or holds the lever 22 in position B and consequently the holding claws 8*a* and 9*a* are held free.

The loading shovel 5 can now be suspended in the claws 2*a* and 3*a*, which are open on top.

By hydraulic actuation of the lift chassis which forms part of the carrier vehicle, the loading shovel 5 is raised and swung to such an extent that bolts 5*a* of the loading shovel 5 engage in the semicircular recesses 25 of the lower holding claws 8*a* and 9*a*, the semicircular recesses having the center point 25*a*.

After the bolt 23 has been withdrawn and upon the return of the lever 22 into position A, the loading shovel 5 is held fast by means of the mechanism described above. The lever 22 is secured in its position by inserting the bolt 23 through the hole 22*a* in the lever 22 and through the bore 9*d* in the stay arm 9.

While we have disclosed one embodiment of the present invention, it is to be understood that this embodiment is given by example only and not in a limiting sense.

We claim:

1. A rapid-change device for attachments on earth moving machines for connection between a lifting frame chassis which is hydraulically actuated from a carrier vehicle and an attachment implement, for instance a loading shovel having holding bolts, by means of holding claws and locking latches, comprising a lifting frame chassis having lift arms, stay arms formed with holding claws, respectively, hubs are fixedly connected on said stay arms, respectively, said hubs are formed with bores, locking latches are pivotally mounted on the outer periphery of said hubs, respectively, defining pivot points, said lift arms of the lifting frame chassis are coaxially pivotally mounted in said bores of said hubs, said stay arms are formed with semicircular recesses of said holding claws adapted to receive holding bolts of the loading shovel, respectively, the center points of the semicircular recesses of said holding claws and said pivot points of said locking latches are coordinated with respect to each other such that the line of action of reaction forces introduced by the loading shovel extends through said pivot points for said locking latches and at lowest through said center points of said semicircular recesses.

2. The rapid-change device according to claim 1, wherein said locking latches are mounted independently of each other on said hubs, respectively, said stay arms are formed with bores, shift shaft means for actuating said locking latches is mounted in said bores of said stay arms.

3. The rapid-change device according to claim 2, further comprising a tubular cross member, said shift shaft means for actuating said locking latches is disposed inside of said tubular cross member, the latter operatively carries said locking latches and said holding claws arranged on both sides.

4. The rapid-change device as set forth in claim 1, wherein said line of action of reaction forces extends through said center points of said semicircular recesses.

5. The rapid-change device as set forth in claim 1, wherein said line of action of reaction forces extends above said center points of said semicircular recesses.

6. The rapid-change device as set forth in claim 3, further comprising levers secured to free ends of said shift shaft means, pins secured to said locking latches and operatively connected to said levers, respectively, additional stay arms mounted on the center third of said tubular cross member and having additional holding claws open at the top and adapted to receive bolts of the loading shovel therein, respectively, said first-mentioned stay arms are fixedly secured to said tubular cross member, bolt means for releaseably securing said one of said levers and one of said first mentioned stay arms.

7. The rapid-change device as set forth in claim 6, wherein said levers are formed with forked ends defining elongated slots, respectively, said pins are disposed in said elongated slots, respectively, said locking latches are formed with downwardly extending hook portions complementary to said semicircular recesses and cooperatively latching over the holding bolts of said loading shovel in said semicircular recesses, respectively, in an interlocked position.

* * * * *